US007269962B2

(12) United States Patent
Bachmann

(10) Patent No.: US 7,269,962 B2
(45) Date of Patent: Sep. 18, 2007

(54) COOLING MEDIUM COMPRESSOR ARRANGEMENT

(75) Inventor: Ole Schebel Bachmann, Sønderborg (DK)

(73) Assignee: Danfoss Compressors GmbH, Flensburg (DE)

( * ) Notice: Subject to any disclaimer, the term of this patent is extended or adjusted under 35 U.S.C. 154(b) by 301 days.

(21) Appl. No.: 10/837,821

(22) Filed: May 3, 2004

(65) Prior Publication Data

US 2004/0221590 A1 Nov. 11, 2004

(30) Foreign Application Priority Data

May 6, 2003 (DE) ..... 103 20 021

(51) Int. Cl.
*F25B 49/00* (2006.01)
*G08B 17/10* (2006.01)

(52) U.S. Cl. ..... 62/126; 62/127; 62/129; 340/632

(58) Field of Classification Search ..... 62/125, 62/126, 127, 129, 130; 340/632, 633, 634
See application file for complete search history.

(56) References Cited

U.S. PATENT DOCUMENTS 4,007,456 A * 2/1977 Paige et al. ..... 340/507
4,381,549 A 4/1983 Stamp, Jr. et al.
5,443,795 A * 8/1995 Revesz ..... 422/90
6,644,047 B2 * 11/2003 Taira et al. ..... 62/129
6,772,598 B1 * 8/2004 Rinehart ..... 62/126

FOREIGN PATENT DOCUMENTS

| | | | |
|---|---|---|---|
| DE | 19806041 | | 8/1999 |
| EP | 0 726 430 B1 | | 7/2002 |
| JP | 59-95326 | * | 6/1984 |
| JP | 8-61702 | * | 3/1996 |
| JP | 2003042655 | | 2/2003 |

OTHER PUBLICATIONS

Ewald Preisegger, "Lecksuche mit frigen", Die Kalte May 1976, pp. 190-200, Hoechst Aktiengesellschaft Frankfurt (Main) 80.

* cited by examiner

*Primary Examiner*—Marc Norman
(74) *Attorney, Agent, or Firm*—McCormick, Paulding & Huber LLP

(57) ABSTRACT

A cooling medium compressor arrangement is comprised of a compressor, a control mechanism electrically connected with the compressor, and a gas sensor, and the safety of the arrangement is improved by arranging the control mechanism and the gas sensor in a common housing.

10 Claims, 2 Drawing Sheets

COOLING MEDIUM COMPRESSOR ARRANGEMENT

CROSS-REFERENCE TO RELATED APPLICATIONS

This application is entitled to the benefit of and incorporates by reference essential subject matter disclosed in German Patent Application No. 10320021.5 filed on May 6, 2003.

FIELD OF THE INVENTION

The invention concerns a cooling medium compressor arrangement with a compressor, a control mechanism electrically connected with the compressor, and a gas sensor.

BACKGROUND OF THE INVENTION

In keeping with an increasing environmental consciousness cooling medium compressors which operate with environmentally friendly cooling mediums are achieving an always greater significance. Especially, one is prompted to avoid cooling mediums which stand in suspicion of creating a hothouse effect.

Therefore, increasingly cooling mediums are used which have hydrocarbon bases, for example a cooling medium R600 (isobutane). Such cooling mediums are today heavily used in Europe and a number of cooling furniture pieces offered on the European market are operated with cooling medium R600.

Some of the environmentally friendly cooling mediums have above all the disadvantage that they are easily ignitable. This leads in connection with further development of cooling medium compressors to the following problem: on energy saving grounds increasingly compressors are used whose rotational speeds are variable. Such compressors are electronically controlled. Possibly this control among other things includes the use of new motor technologies, for example permanent magnet excited motors or one, two, or three phase induction motors.

Such compressors, or more correctly said their drive motors, are not only switched on and off, but are much more controlled by way of power semiconductors. In connection with this control a situation can arise by way of which an ignitable gas mixture can become ignited.

If therefore two fault possibilities appear at the same time, namely first a leak in the cooling system through which the cooling medium can escape, and secondly a fault in the electronic control, an ignition of the cooling medium gases can occur. If this ignition occurs suddenly, it can indeed produce small explosions.

Therefore, in JP 8-247 646 A it is proposed that a gas sensor be arranged in the cooling space and that an electrical supply be interrupted if the sensor determines the presence of gas. In this case it is necessary to provide an electrical conductor between the gas sensor and the control mechanism to connect the gas sensor from the interior of the cooling cabinet with the control mechanism.

Along with this there are further possibilities for solving this problem, which are briefly set forth as follows:

One can provide a fuse, that is a glass fuse, in a power supply phase. This is today a very widely used solution. The glass fuse is, however, typically relatively unreliable and in the manufacturing of the compressor is difficult to manage.

One can hermetically seal the housing of the control mechanism so that the cooling medium gas in the case of a leak in the cooling arrangement cannot penetrate to the components of the control mechanism. The sealing of the housing is, however, difficult. It leads moreover in many cases to thermal problems in the control mechanism.

One can diminish the free volume in the housing of the control mechanism so far that it is smaller than 20 $cm^3$. This is the limiting value of a safety standard. This can be achieved for example, by the moulding of a filling or potting material into the housing in which the control mechanism is contained. Above all, this solution is relatively expensive and mechanically loads the components of the control mechanism, especially by material movement with increased temperatures.

The invention has as its object the improvement of safety in cooling medium compressor arrangements.

SUMMARY OF THE INVENTION

This object is solved for a cooling medium compressor arrangement of the previously mentioned kind in that the control mechanism and the gas sensor are arranged in a common housing. One proceeds from this in that the cooling medium gas, e.g. butane, is heavier than air and itself in the case of a leak moves downwardly to where the compressor is located in a cooling piece of furniture, e.g. a cooling cabinet. At that place are also located the components which are critical, namely the components of the control mechanism. If one now locates the gas sensor at the spot where critical situations can exist, then one is in the position to effect an interruption of the drive of the cooling medium compressor arrangement if an increasing concentration of gas in the housing of the control mechanism is indicated. The gas in general does not appear suddenly in such a high concentration that immediately a dangerous situation comes into existence. The gas in general can only relatively slowly penetrate into the housing of the control mechanism so that the gas sensor can detect the presence of gas before in the housing itself a concentration occurs which could lead to an explosion or a fire. On the other hand, one determines, however, the presence of gas exactly at the position where the gas represents a risk, namely in the immediate environment of the components of the control mechanism. The gas concentration at other locations is much more of lesser interest.

Preferably, at least part of the housing is gas permeable. One must therefore not use any hermetically sealed capsules, but can use an economical housing, such as for example IP20. This has among other things the advantage that an air exchange with the surroundings is possible, which in turn simplifies the cooling of the electronic components of the control mechanism.

Preferably, the housing has a gas permeable region in which the gas sensor is arranged, and a gas tight region in which the control mechanism is arranged. Thereby, an increased safety against an ignition of the cooling medium gas by the power electronics of the control mechanism is achieved. The gas sensor is on the other hand in the position to quickly and reliably detect intrusive gases.

In a preferred way the gas sensor is integrated into an electronic circuit of the control mechanism. In this way one obtains the advantage that no additional conductors between the gas sensor and the control mechanism are necessary. For example, the gas sensor can be arranged on a circuit board onto which components of the control mechanism are also arranged.

In this case, it is preferred that the gas sensor is a component of a voltage divider arrangement. The resistance of the gas sensor changes in dependence on the concentration of the gas which the gas sensor is to detect. One can provide only one threshold value circuit which with a voltage divider is in the position to relatively quickly detect the exceeding of a desired voltage level.

It is also advantageous if the gas sensor is connected with a microcontroller. Instead of a microcontroller one can also use an ASIC, that is an application specific integrated circuit. Such a constructed electronic circuitry is "intelligent" enough. It is in general protectionwise of as high a reliability as electromechanical solutions.

In connection with the above it is preferred that the microcontroller forms an evaluation and memory apparatus by means of which a timewise course of a cooling medium loss is documentable. Depending on circumstances one can by way of the obtained information produce a report about the amount of the cooling medium remaining in the cooling system.

Preferably, along with the mentioned gas sensor at least one further gas sensor is provided. This increases the redundancy and increases the reliability during operation of the compressor arrangement.

It is preferred that a selection mechanism be provided which brings into use an as yet not used gas sensor after at least one of the following criteria appears: a predetermined operating time of a used gas sensor has elapsed or a used gas sensor is functionally impaired. Gas sensors in general have only a limited lifetime. This operating time can indeed amount to several years. The lifetime of a piece of cooling furniture can, however, be still longer. If one now provides several sensors which are brought into operation serially, then one can suit the lifetime of the control electronic circuitry with gas sensors to the lifetime of the piece of cooling furniture.

In an alternative embodiment, it is provided that several gas sensors operate simultaneously. This increases the redundancy, that is upon the failure of one gas sensor the other gas sensors can continue to operate.

BRIEF DESCRIPTION OF THE DRAWINGS

The invention is described in more detail in the following by way of a preferred embodiment in connection with the drawings, which are.

DETAILED DESCRIPTION OF THE PREFERRED EMBODIMENTS

Figure 1:
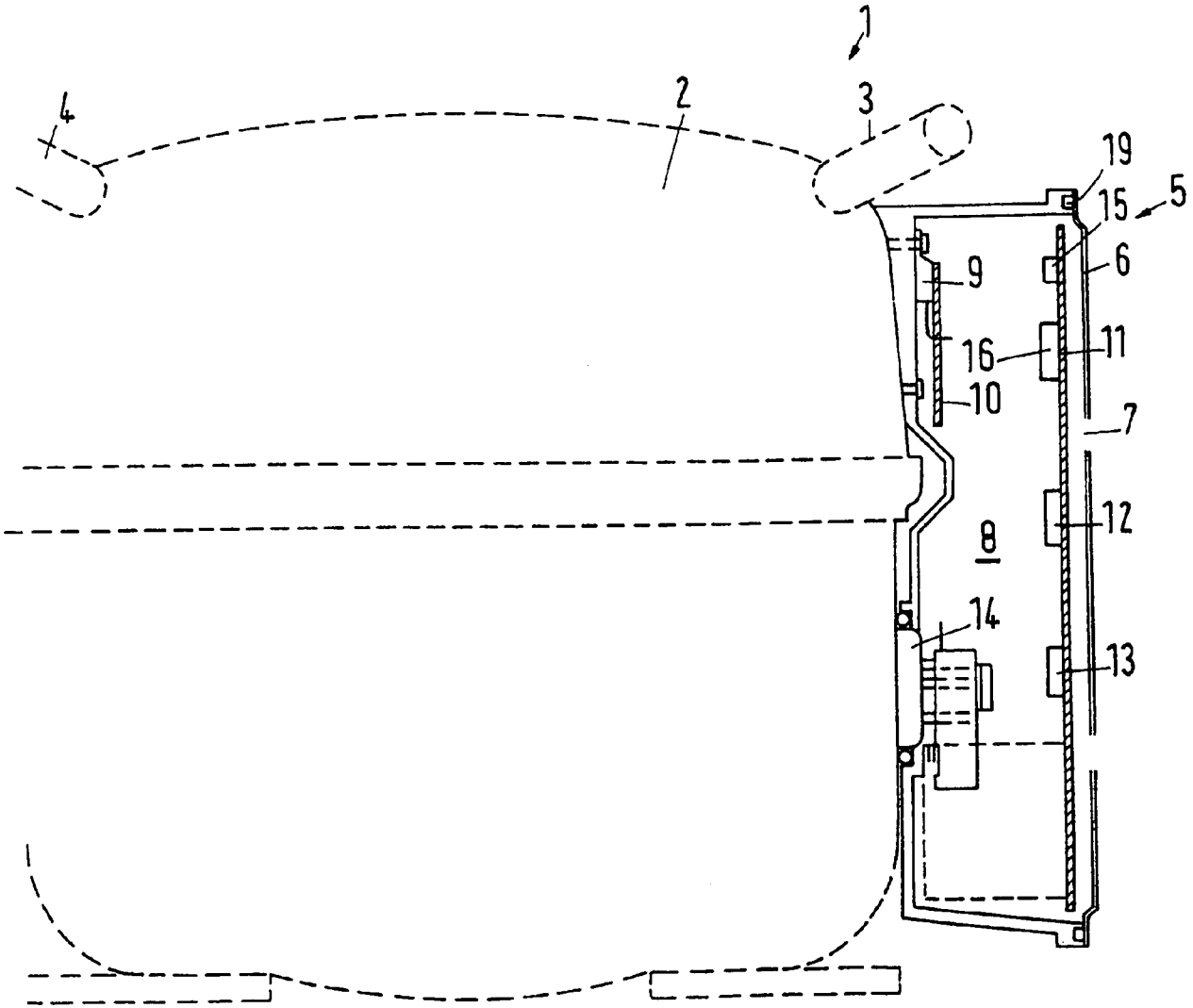
FIG. 1 is a schematic view of a cooling medium compressor arrangement.

A cooling medium compressor arrangement 1 has a capsule 2 which is hermetically sealed and which in a known and therefore not in more detail illustrated way endoses a cooling medium compressor with an electric drive motor. The capsule 2 has a suction nipple 3 and an output nipple 4 to which a cooling medium circuit is connected in a way not illustrated in more detail, which circuit along with the compressor arrangement also includes a condenser and an evaporator as well as usually an expansion valve. A cooling medium circulates in this circuit and is at least partially in gaseous form. This cooling medium is for example the cooling medium R600 (isobutane). This cooling medium is characterized in that it is relatively environmentally friendly, and therefore does not contribute to the hothouse effect, if by way of a leak it escapes from the cooling apparatus.

The compressor arrangement 1 in general is arranged in a region of a cooling piece of furniture, for example a cooling cabinet, which region in the direction of gravity lies relatively far down. The cooling medium R600 is heavier than air. In the case of a sealing leak in the cooling medium circuit the cooling medium will therefore sink downwardly and thereby move into the neighborhood of the compressor arrangement 1.

For the control of the compressor, more exactly of its drive motor, a control mechanism 5 is provided on the side of the capsule 2. This control mechanism 5 includes a housing 6, which is not gas tight, but indeed can even have holes or openings 7. It is therefore absolutely possible that the gas, which sinks downwardly, can also penetrate into the inner space 8 of the housing 6 in which the electrical components are arranged. Without additional measures this can lead to dangerous situations if the concentration of the gases in the interior space 18 becomes such that an ignitable mixture exists and if moreover electrical components of the control apparatus 5 become hot or create sparks, so that the ignitable and burnable mixture burns or indeed explodes.

By way of the electrical components, they can for example include power semiconductors 9 arranged on a circuit board 10. A further circuit board 11 is provided, which for example carries components 12,13, which are used for the control of the power semiconductors 9. A through guide 14 is provided to transmit electrical power into the interior of the capsule 2.

A gas sensor 15 is arranged on the circuit board 11. The gas sensor 15 is a component of a circuit which also includes a microcontroller 16. The gas sensor 15 can for example be a sensor of the type CAP03L, which can be obtained from the firm Captuer Sensors in England. The sensor is sensitive to butane.

Such sensors 15 have a minimum lifetime of three years. To assure a longer operation of the control mechanism 5 one can in a non-illustrated way also provide two or more sensors on the circuit board 11, with a selecting mechanism being provided which first puts into use a not yet used sensor if the first sensor no longer functions or if a predetermined lifetime has elapsed. Above all, one can also on grounds of redundancy and security build in several gas sensors which work simultaneously.

Figure 2:
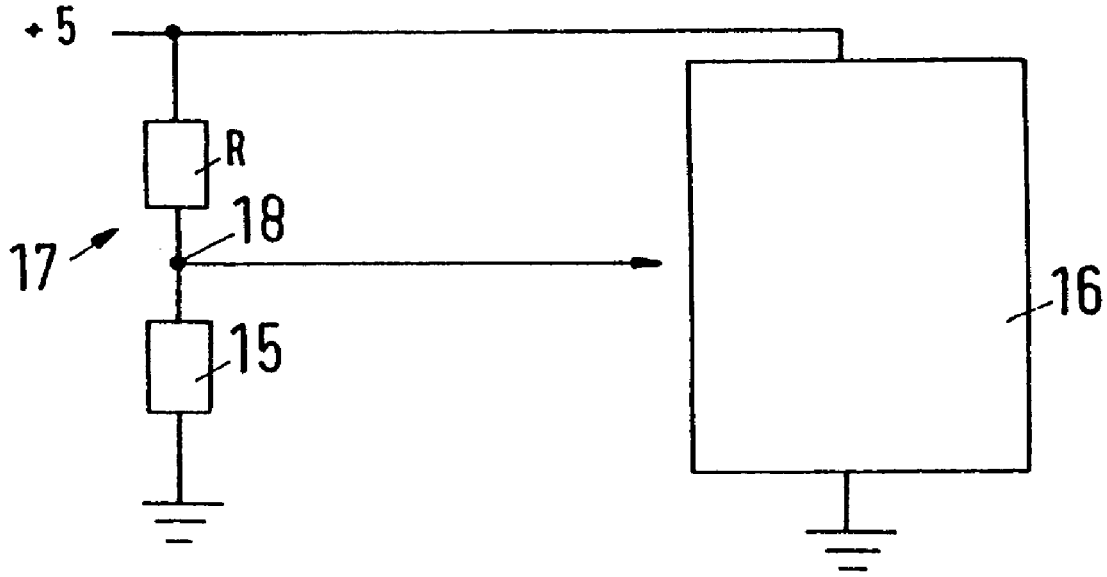
FIG. 2 is a schematic illustration of a circuit arrangement with a gas sensor.

FIG. 2 shows schematically a circuit arrangement in which the gas sensor 15 is a component of a voltage dividing circuit, which additionally includes an ohmic resistance R. The voltage divider 17 has a middle tap 18 which is connected with the mentioned microcontroller 16. Instead of a microcontroller one naturally can also use other electrical components which fulfill the same function, for example an ASIC. The resistance of the gas sensor 15 changes in dependence on the gas concentration of the monitored gas. The microcontroller 16 can easily determine the falling below or the exceeding of a threshold value of voltage at the middle tap 18, and upon the exceeding of a given gas concentration, can for example release an alarm. Moreover, a signal can be transmitted to an electronic thermostat which by way of a display or a pulsating light emitting diode or some other optical or acoustic indicator can bring to attention the existence of a danger.

Further, in the case of a too high gas concentration the microcontroller 16 can effect a controlled shutting off of the control mechanism 5 and of the drive of the compressor.

A safety fuse, for example the above mentioned glass fuse, can therefore be avoided. The illustrated electronic circuit is in general reliable.

Therefore, since one can arrange the gas sensor 15 in the housing 6 together with the remaining components of the control mechanism 5 one can use a relatively price efficient housing which for example satisfies only the protection standard of Norm IP20. It is also not necessary to use an hermetically sealed capsule housing. With this one goes upon the assumption that upon the appearance of a leak the gas concentration in the interior space 8 will not rise suddenly. The gas concentration will much more increase with time so that the presence of gas can be detected by the gas sensor 15 before a dangerous gas concentration becomes present in the interior space 8. The housing 6 takes on, for example, the additional function of collecting the escaping gas and of increasing its concentration, so that a detection of escaping gas can be possible even in the case of relatively small escaping amounts of gas. If one were to simply allow the gas to escape into the surroundings, without providing a collecting space, it could happen that the gas concentration would always remain so small that one could not detect it practically with similar expense.

Instead of a sensor 15 arranged in the inner space 8, it is also possible that the sensor be applied in an open and thereby gas permeable section of the housing 6 with the rest of the electronic circuitry including the power semiconductors 9 being located in a gas tight space. In this way, an increase safety against ignition of the gases by components of the power electronics is achieved. One such gas sensor 19 is illustrated schematically in FIG. 1. This sensor 19 is in the case of a disorder relatively simple to exchange.

The microcontroller 16 forms a "relatively intelligent" electronic circuitry. It can during operation deal with a series of messages and store these (data logging). It is then possible to make reports about a gas loss over the course of time. Depending on conditions, a report can then also be made about the amount of cooling medium remaining in the cooling arrangement.

What is claimed is:

1. A cooling medium compressor arrangement comprising:

a compressor;

a gas sensor; and a control mechanism electrically connected with the compressor and the gas sensor;

wherein the control mechanism and the gas sensor are arranged in a common housing.

2. The arrangement of claim 1, wherein the housing at least in part is gas permeable.

3. The arrangement of claim 2, wherein the housing has a gas permeable region in which the gas sensor is arranged, and a gas tight region in which the control mechanism is arranged.

4. The arrangement of claim 1, wherein the gas sensor is integrated into an electronic circuit of the control mechanism.

5. The arrangement of claim 4, wherein the gas sensor is a component of a voltage dividing arrangement.

6. The arrangement of claim 1, wherein the gas sensor is connected with a microcontroller or an ASIC.

7. The arrangement of claim 6, wherein the microcontroller forms an evaluation and memory apparatus by means of which a timewise course of a cooling medium loss is documentable.

8. The arrangement of claim 1, wherein along with the gas sensor at least one further gas sensor is provided.

9. The arrangement of claim 8, wherein a selecting mechanism is provided which brings an as yet non-used gas sensor into use following at least one of the following criteria:

a) a predetermined operating time of a used gas sensor has elapsed, or b) a used gas sensor is functionally impaired.

10. The arrangement of claim 8, wherein a number of gas sensors operate simultaneously.

* * * * *